US006375315B1

(12) United States Patent
Steinmetz et al.

(10) Patent No.: US 6,375,315 B1
(45) Date of Patent: Apr. 23, 2002

(54) REPLACEABLE INK CONTAINER FOR AN INKJET PRINTING SYSTEM

(75) Inventors: Charles R. Steinmetz, Corvallis, OR (US); Scott D. Sturgeon, Vancouver, WA (US); David C. Johnson, Portland, OR (US); Jeffrey T. Hendricks, Camas, WA (US)

(73) Assignee: Hewlett-Packard Company, Fort Collins, CO (US)

( * ) Notice: Subject to any disclaimer, the term of this patent is extended or adjusted under 35 U.S.C. 154(b) by 0 days.

(21) Appl. No.: 09/547,271

(22) Filed: Apr. 11, 2000

(51) Int. Cl.[7] ..... B41J 2/175
(52) U.S. Cl. ..... 347/86; 347/85
(58) Field of Search ..... 347/85, 86, 87, 347/49; 399/25

(56) References Cited

U.S. PATENT DOCUMENTS

| | | | | |
|---|---|---|---|---|
| 4,853,708 A | | 8/1989 | Walters | 347/86 |
| 5,182,581 A | | 1/1993 | Kashimura et al. | 347/87 |
| 5,619,237 A | | 4/1997 | Inoue et al. | 347/86 |
| 5,619,239 A | | 4/1997 | Kotaki et al. | 347/86 |
| 5,784,088 A | | 7/1998 | Ujita et al. | 347/86 |
| 5,812,156 A | | 9/1998 | Bullock et al. | 347/19 |
| 5,835,817 A | | 11/1998 | Bullock et al. | 399/25 |
| 5,949,459 A | * | 9/1999 | Gasvoda et al. | 347/86 |
| 6,000,791 A | * | 12/1999 | Scheffelin et al. | 347/87 |

FOREIGN PATENT DOCUMENTS

EP 0816098 A2 1/1998 ..... B41J/2/175

OTHER PUBLICATIONS

"Prints From New Epson Ink Jets Offer Longevity of Silver Halide," *The Hard Copy Observer*. vol. X No. 2, Feb. 2000, pp. 1, 60–64.

* cited by examiner

*Primary Examiner*—Anh T. N. Vo

(57) ABSTRACT

A replaceable ink container for providing ink to an inkjet printing system. The inkjet printing system has a receiving station that is mounted to a scanning carriage. The receiving station has a keyed portion being indicative of a replaceable ink container parameter of a plurality of replaceable ink container parameters. The replaceable ink container includes a reservoir portion having a leading end and a trailing end relative to an insertion direction into the receiving station. Also included is a keying portion disposed on the trailing end and configured to be complementary to the keyed portion thereby allowing the replaceable ink container to be fully inserted into the receiving station.

26 Claims, 11 Drawing Sheets

REPLACEABLE INK CONTAINER FOR AN INKJET PRINTING SYSTEM

BACKGROUND OF THE INVENTION

The present invention relates to ink containers for providing ink to inkjet printers. More specifically, the present invention relates to a method and apparatus for ensuring that the ink containers inserted into a receiving station within an inkjet printer are compatible with the inkjet printer.

Inkjet printers frequently make use of an inkjet printhead mounted within a carriage that is moved relative to a print media, such as paper. As the printhead is moved relative to the print media, a control system activates the printhead to deposit or eject ink droplets onto the print media to form images and text. Ink is provided to the printhead by a supply of ink that is either integral with the printhead, as in the case of a disposable print cartridge, or by a supply of ink that is replaceable separate from the printhead.

One type of previously used printing system makes use of the ink supply that is carried with the carriage. This ink supply has been formed integral with the printhead, whereupon the entire printhead and ink supply are replaced when ink is exhausted. Alternatively, the ink supply can be carried with the carriage and be separately replaceable from the printhead. For the case where the ink supply is separately replaceable, the ink supply is replaced when exhausted. The printhead is then replaced at the end of printhead life. Regardless of where the ink supply is located within the printing system, it is critical that the ink supply provide a reliable supply of ink to the inkjet printhead.

There is an ever present need for inkjet printing systems that make use of replaceable ink containers that are easy to install and remove. The installation of the ink container should produce reliable fluidic connection to the printer. These ink containers should have some means of cooperating with a supply station within the printing system for preventing the insertion of ink supplies that are incompatible with the printing system. Finally, these ink containers should be relatively easy to manufacture, thereby tending to reduce the ink supply cost as well as per page printing costs.

SUMMARY OF THE INVENTION

One aspect of the present invention is a replaceable ink container for providing ink to an inkjet printing system. The inkjet printing system has a receiving station that is mounted to a scanning carriage. The receiving station has a keyed portion indicative of a replaceable ink container parameter of a plurality of replaceable ink container parameters. The replaceable ink container includes a reservoir portion having a leading end and a trailing end relative to an insertion direction into the receiving station. Also included is a keying portion disposed on the trailing end and configured to be complementary to the keyed portion thereby allowing the replaceable ink container to be fully inserted into the receiving station.

Another aspect of the present invention is wherein the keying portion is a plurality of tabs that extend outwardly from the reservoir portion. The replaceable ink container has a top surface and a bottom surface relative to an insertion orientation and wherein the tabs are disposed in a side by side relationship toward the bottom surface of the trailing edge.

Yet another aspect of the present invention is wherein the keying portion and the keyed portion cooperate to prevent insertion of replaceable ink containers that are not compatible with the supply station. The replaceable ink container when inserted into the receiving station in a horizontal direction where the keying portion is positioned proximate the keyed portion the replaceable ink container is then pivoted about a pivot axis if the keying portion is compatible with the keyed portion to engage a fluid outlet disposed on the reservoir portion with a fluid inlet disposed on the supply station.

DETAILED DESCRIPTION OF THE PREFERRED EMBODIMENT

Figure 1:
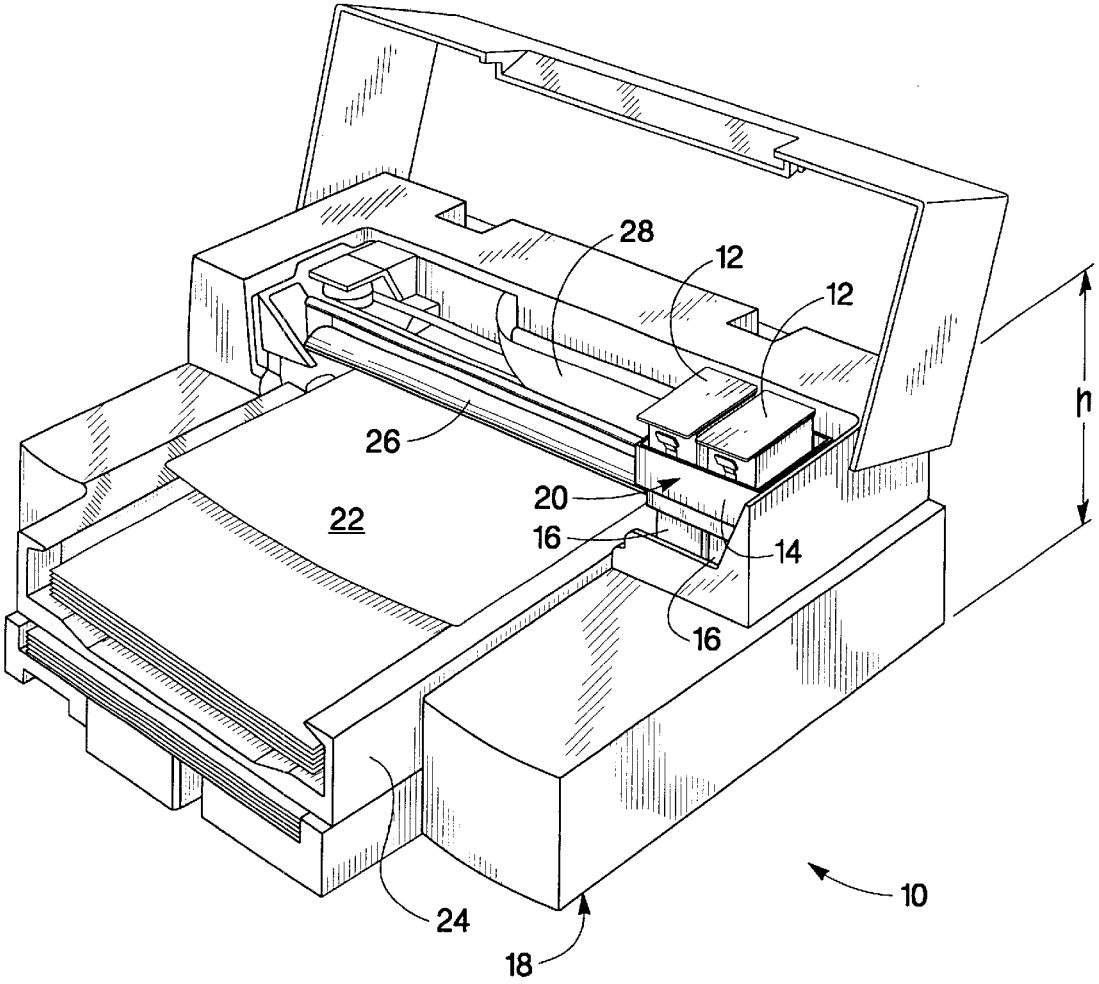
FIG. 1 is one exemplary embodiment of an ink jet printing system of the present invention shown with a cover opened to show a plurality of replaceable ink containers of th sent invention.

FIG. 1 is a perspective view of one exemplary embodiment of a printing system 10 shown with its cover open, that includes at least one replaceable ink container 12 that is installed in a receiving station 14. With the replaceable ink container 12 properly installed into the receiving portion 14, ink is provided from the replaceable ink container 12 to at least one inkjet printhead 16. The inkjet printhead 16 is responsive to activation signals from a printer portion 18 to deposit ink on print media. As ink is ejected from the printhead 16, the printhead 16 is replenished with ink from the ink container 12. In one preferred embodiment the replaceable ink container 12, receiving station 14, and inkjet printhead 16 are each part of a scanning carriage 20 that is moved relative to a print media 22 to accomplish printing.

The printer portion 18 includes a media tray 24 for receiving the print media 22. As the print media 22 is stepped through a print zone, the scanning carriage 20 moves the printhead 16 relative to the print media 22. The printer portion 18 selectively activates the printhead 16 to deposit ink on print media 22 to thereby accomplish printing.

The scanning carriage 20 is moved through the print zone on a scanning mechanism which includes a slide rod 26 on which the scanning carriage 20 slides as the scanning carriage 20 moves through a scan axis. A positioning means (not shown) is used for precisely positioning the scanning carriage 20. In addition, a paper advance mechanism (not shown) is used to step the print media 22 through the print zone as the scanning carriage 20 is moved along the scan axis. Electrical signals are provided to the scanning carriage 20 for selectively activating the printhead 16 by means of an electrical link such as a ribbon cable 28.

An important aspect of the present invention is the method and apparatus for ensuring that the ink containers 12 that are inserted into the receiving station 14 are compatible with the receiving station 14. The ink containers 12 may contain a number of different ink types or a number of different ink colors. These different ink types may have different chemical or physical properties such as different ink viscosity of different solubility in water to name a few. Inkjet printheads 16 that are designed to work with ink of a particular ink type will malfunction if a different ink type is used. The ink color relates to one of four colors that are typically used in color printing and combined on the printing medium to yield the sought-after color output. The receiving station is in fluid communication with the printhead 16 for providing ink to the printhead 16. Because each printhead or printhead portion 16 is associated with an ink color then the receiving station 14 is limited for use with the same colors and, therefore, these colors must not be contaminated with ink of any other color.

The ink container 12 of the present invention includes features formed thereon to provide indicia of the particular ink type or ink color of the ink contained in the reservoir. Similar features are provided in the receiving station 14. These features on the ink container 12 and in the receiving station 14 are the primary components of a system that prevents insertion of any ink containers 12 into a receiving station 14, except for the single ink supply container 12 that has a complementary feature for mating with corresponding features of the receiving station 14.

The method and apparatus of the present invention, as will be discussed with respect to FIGS. 2 through 11, depict those features which allow the replaceable ink container 12 to be inserted into the receiving station 14 in such a manner that reliable fluidic connection is established between the replaceable ink container 12 and the receiving station 14. Prior to establishing the fluidic connection the method and apparatus of the present invention ensures that the replaceable ink container 12 is compatible with the particular bay within the receiving station 14 to ensure an ink path within the receiving station 14 and printhead 16 is not contaminated with ink of a different type or of a different color.

Figure 2:
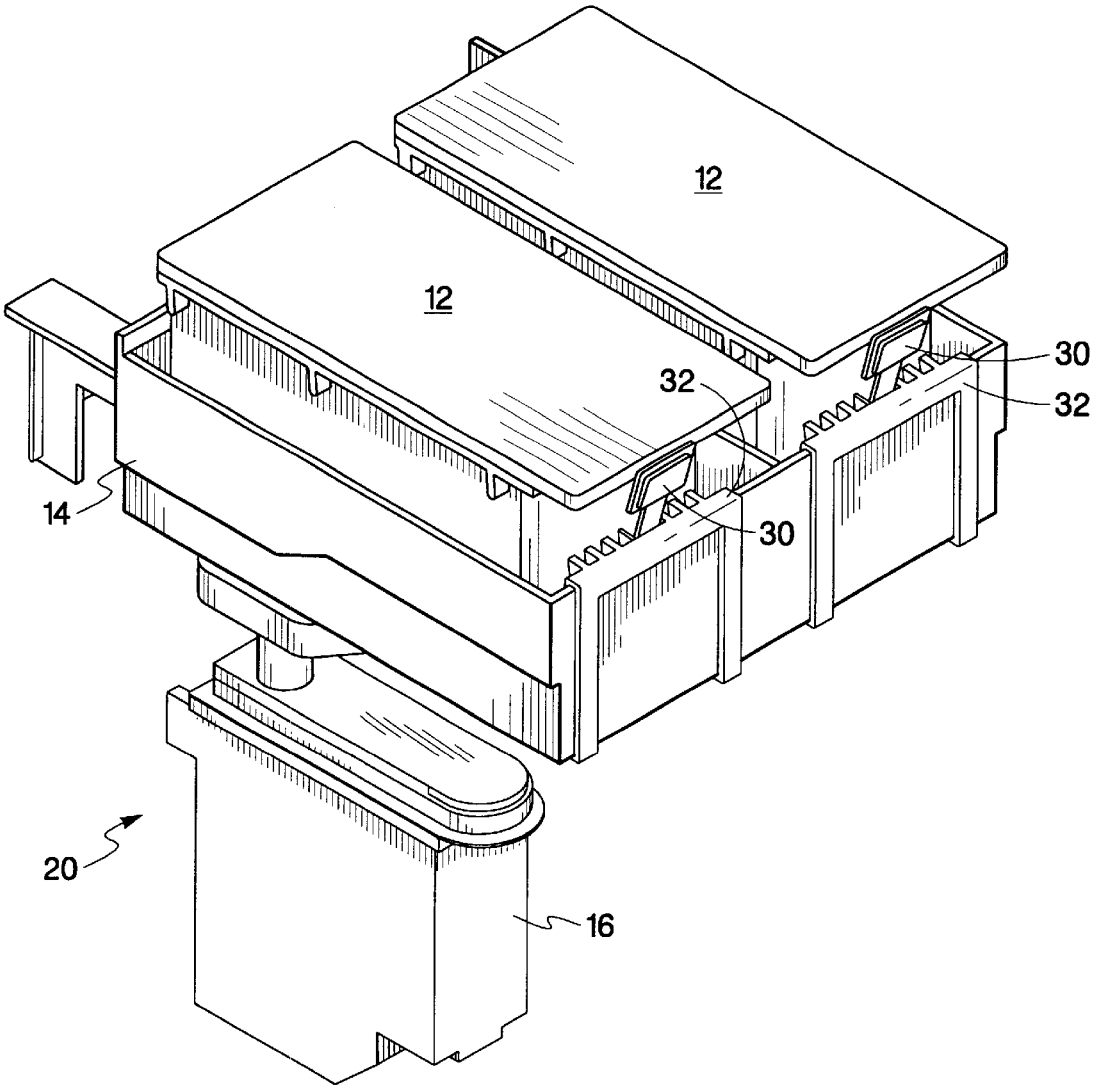
FIG. 2 is a greatly enlarged perspective view of a portion of a scanning carriage showing the replaceable ink containers of the present invention positioned in a receiving station that provides fluid communication between the replaceable ink containers and or more printhead.

FIG. 2 is a perspective view of a portion of the scanning carriage 20 showing a pair of replaceable ink containers 12 properly installed in the receiving station 14. An inkjet printhead 16 is in fluid communication with the receiving station 14. In the preferred embodiment, the inkjet printing system 10 shown in FIG. 1 includes a tri-color ink container containing three separate ink colors and a second ink container containing a single ink color. In this preferred embodiment, the tri-color ink container contains cyan, magenta, and yellow inks, and the single color ink container contains black ink for accomplishing four-color printing. The replaceable ink containers 12 can be partitioned differently to contain fewer than three ink colors or more than three ink colors if more are required. For example, in the case of high fidelity printing, frequently six or more colors are used to accomplish printing.

The receiving station 14 shown in FIG. 2 is shown fluidically coupled to a single printhead 16 for simplicity. In the preferred embodiment, four inkjet printheads 16 are each fluidically coupled to the receiving station 14. In this preferred embodiment, each of the four printheads are fluidically coupled to each of the four colored inks contained in the replaceable ink containers. Thus, the cyan, magenta, yellow and black printheads 16 are each coupled to their corresponding cyan, magenta, yellow and black ink supplies, respectively. Other configurations which make use of fewer printheads than four are also possible. For example, the printhead 16 can be configured to print more than one ink color by properly partitioning the printhead 16 to allow a first ink color to be provided to a first group of ink nozzles and a second ink color to be provided to a second group of ink nozzles, with the second group of ink nozzles different from the first group. In this manner, a single printhead 16 can be used to print more than one ink color allowing fewer than four printheads 16 to accomplish four-color printing. The fluidic path between each of the replaceable ink containers 12 and the printhead 16 will be discussed in more detail with respect to FIG. 3.

Each of the replaceable ink containers 12 include a latch 30 for securing the replaceable ink container 12 to the receiving station 14. The receiving station 14 in the preferred embodiment includes a set of keyed features 32 that interact with corresponding keying features (not shown) on the replaceable ink container 12. The keying features on the replaceable ink container 12 interact with the keyed features 32 on the receiving station 14 to ensure that the replaceable ink container 12 is compatible with the receiving station 14.

Figure 3:
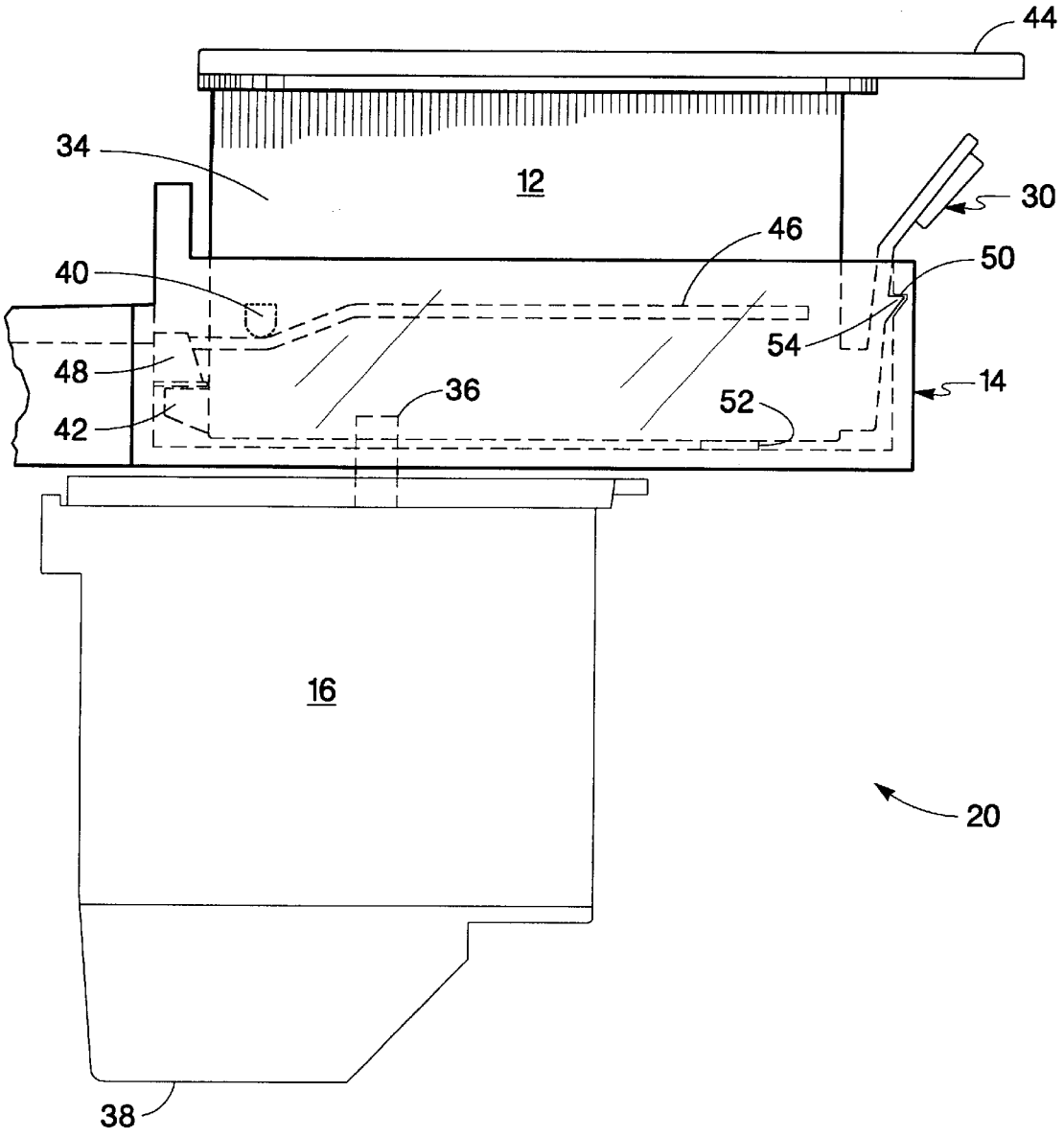
FIG. 3 is a side plan view of a portion of the scanning carriage showing guiding and latching features associated with each of the replaceable ink container and the receiving station for securing the replaceable ink container, thereby allowing fluid communication with the printhead.

FIG. 3 is a side plan view of the scanning carriage portion 20 shown in FIG. 2. The scanning carriage portion 20 includes the ink container 12 shown properly installed into the receiving station 14, thereby establishing fluid communication between the replaceable ink container 12 and the printhead 16.

The replaceable ink container 12 includes a reservoir portion 34 for containing one or more quantities of ink. In the preferred embodiment, the tri-color replaceable ink container 12 has three separate ink containment reservoirs, each containing ink of a different color. In this preferred embodiment, the monochrome replaceable ink container 12 is a single ink reservoir 34 for containing ink of a single color.

In the preferred embodiment, the reservoir 34 has a capillary storage member (not shown) disposed therein. The capillary storage member is a porous member having sufficient capillarity to retain ink to prevent ink leakage from the reservoir 34 during insertion and removal of the ink container 12 from the printing system 10. This capillary force must be sufficiently great to prevent ink leakage from the ink reservoir 34 over a wide variety of environmental conditions such as temperature and pressure changes. In addition, the capillarity of the capillary member is sufficient to retain ink within the ink reservoir 34 for all orientations of the ink reservoir as well as a reasonable amount of shock and vibration the ink container may experience during normal handling. The preferred capillary storage member is a network of heat bonded polymer fibers described in US Patent Application entitled "Ink Reservoir for an Inkjet Printer" attorney docket 10991407 filed on Oct. 29, 1999, Ser. No. 09/430,400, assigned to the assignee of the present invention and incorporated herein by reference.

Once the ink container 12 is properly installed into the receiving station 14, the ink container 12 is fluidically coupled to the printhead 16 by way of fluid interconnect 36. Upon activation of the printhead 16, ink is ejected from the ejection portion 38 producing a negative gauge pressure, sometimes referred to as backpressure, within the printhead 16. This negative gauge pressure within the printhead 16 is sufficient to overcome the capillary force, retaining ink within the capillary member disposed within the ink reservoir 34. Ink is drawn by this backpressure from the replaceable ink container 12 to the printhead 16. In this manner, the printhead 16 is replenished with ink provided by the replaceable ink container 12.

The fluid interconnect 36 is preferably an upstanding ink pipe that extends upwardly into the ink container 12 and downwardly to the inkjet printhead 16. The fluid interconnect 36 is shown greatly simplified in FIG. 3. In the preferred embodiment, the fluid interconnect 36 is a manifold that allows for offset in the positioning of the printheads 16 along the scan axis, thereby allowing the printhead 16 to be placed offset from the corresponding replaceable ink container 12. In the preferred embodiment, the fluid interconnect 36 extends into the reservoir 34 to compress the capillary member, thereby forming a region of increased capillarity adjacent the fluid interconnect 36. This region of increased capillarity tends to draw ink toward the fluid interconnect 36, thereby allowing ink to flow through the fluid interconnect 36 to the printhead 16. As will be discussed, it is crucial that the ink container 12 be properly positioned within the receiving station 14 such that proper compression of the capillary member is accomplished when the ink container 12 is inserted into the receiving station. Proper compression of the capillary member is necessary to establish a reliable flow of ink from the ink container 12 to the printhead 16.

The replaceable ink container 12 further includes a guide feature 40, an engagement feature 42, a handle 44 and a latch feature 30 that allow the ink container 12 to be inserted into the receiving station 14 to achieve reliable fluid interconnection with the printhead 16 as well as to form reliable electrical interconnection between the replaceable ink container 12 and the scanning carriage 20 as will be discussed with respect to FIGS. 7*a* through 7*c* and 8*a* through 8*b*.

The receiving station 14 includes a guide rail 46, an engagement feature 48 and a latch engagement feature 50. The guide rail 46 cooperates with the guide rail engagement feature 40 and the replaceable ink container 12 to guide the ink container 12 into the receiving station 14. Once the replaceable ink container 12 is fully inserted into the receiving station 14, the engagement feature 42 associated with the replaceable ink container engages the engagement feature 48 associated with the receiving station 14, securing a front end or a leading end of the replaceable ink container 12 to the receiving station 14. The ink container 12 is then pressed downward to compress a spring biasing member 52 associated with the receiving station 14 until a latch engagement feature 50 associated with the receiving station 14 engages a hook feature 54 associated with the latch member 30 to secure a back end or trailing end of the ink container 12 to the receiving station 14. It is the cooperation of the features on the ink container 12 with the features associated with the receiving station 14 that allow proper insertion and functional interfacing between the replaceable ink container 12 and the receiving station 14. The receiving station 14 will now be discussed in more detail with respect to FIG. 4.

Figure 4:
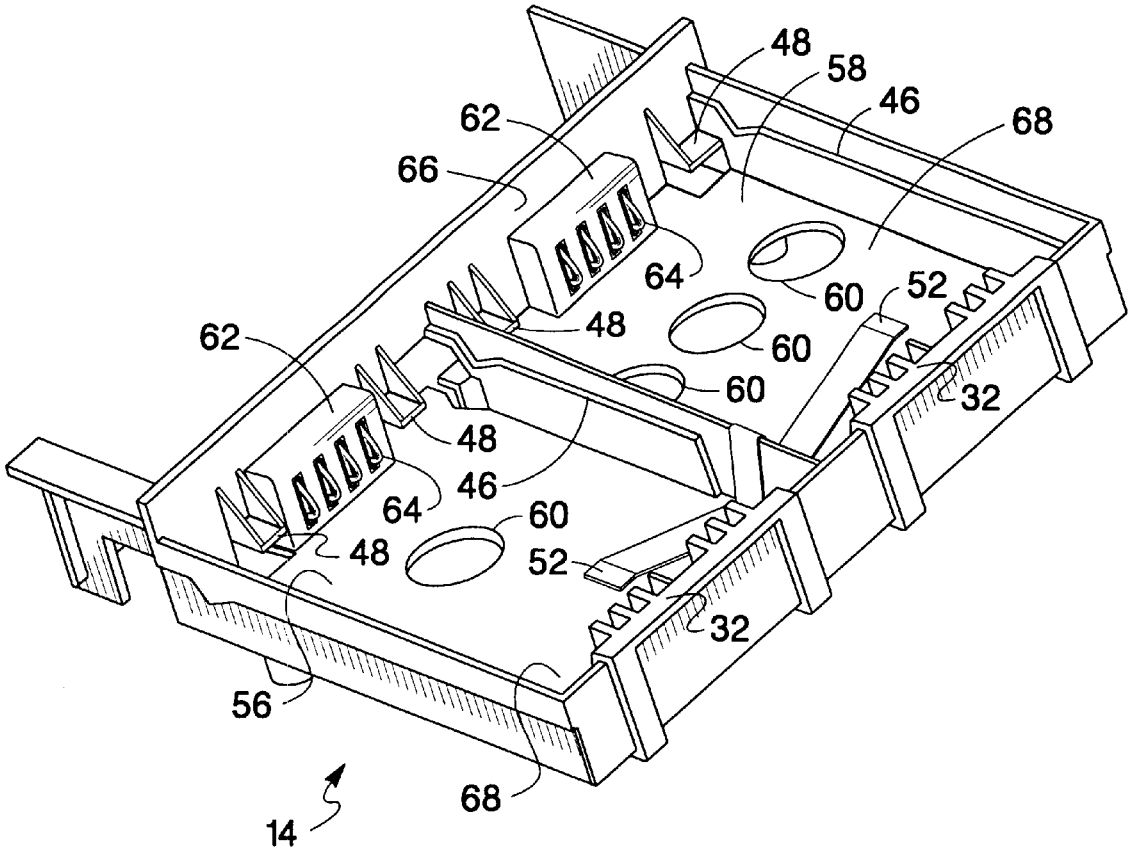
FIG. 4 depicts a receiving station shown in isolation for receiving one or more replaceable ink containers of the present invention.

FIG. 4 is a front perspective view of the receiving station 14 shown in isolation. The receiving station 14 shown in FIG. 4 includes a monochrome bay 56 for receiving an ink container 12 containing a single ink color and a tri-color bay 58 for receiving an ink container having three separate ink colors contained therein. In this preferred embodiment, the monochrome bay 56 receives a replaceable ink container 12 containing black ink, and the tri-color bay receives a replaceable ink container containing cyan, magenta, and yellow inks, each partitioned into a separate reservoir within the ink container 12. The receiving station 14 as well as the replaceable ink container 12 can have other arrangements of bays 56 and 58 for receiving ink containers containing different numbers of distinct inks contained therein. In addition, the number of receiving bays 56 and 58 for the receiving station 14 can be fewer or greater than two. For example, a receiving station 14 can have four separate bays for receiving four separate monochrome ink containers 12 with each ink container containing a separate ink color to accomplish four-color printing.

Each bay 56 and 58 of the receiving station 14 includes an aperture 60 for receiving the upright fluid interconnect 36 that extends therethrough. The fluid interconnect 36 is a fluid inlet for ink to exit a corresponding fluid outlet associated with the ink container 12. An electrical interconnect 62 is also included in each receiving bay 56 and 58. The electrical interconnect 62 includes a plurality of electrical contacts 64. In the preferred embodiment, the electrical contacts are an arrangement of four spring-loaded electrical contacts with proper installation of the replaceable ink container 12 into the corresponding bay of the receiving station 14. Proper engagement with each of the electrical connectors 62 and fluid interconnects 36 must be established in a reliable manner.

The guide rails 46 disposed on either side of the fluid interconnects within each bay 56 and 58 engage the corresponding guide feature 40 on either side of the ink container 12 to guide the ink container into the receiving station. When the ink container 12 is fully inserted into the receiving station 14, the engagement features 48 disposed on a back wall 66 of the receiving station 14 engage the corresponding engagement features 42 shown in FIG. 3 on the ink container 12. The engagement features 48 are disposed on either side of the electrical interconnect 62. A biasing means 52 such as a leaf spring is disposed within the receiving station 14. The leaf spring 52 provides a biasing force which tends to urge the ink container 12 upward from a bottom surface 68 of the receiving station 14. The leaf spring aids in the latching of the ink container 12 to the receiving station 14 as well as aiding the removal of the ink container 12 from the receiving station as will be discussed with respect to FIGS. 8 and 9.

Figure 5C:
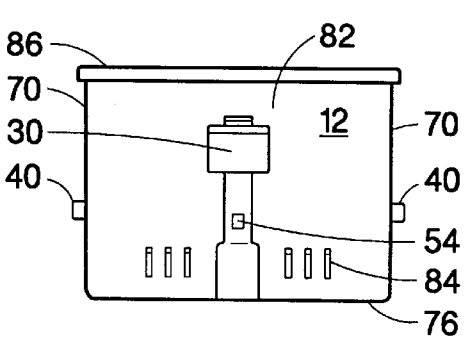
FIGS. 5*a*, 5*b*, 5*c*, and 5*d* are isometric views of a three-color replaceable ink container of the present invention shown in isolation.
Figure 5B:
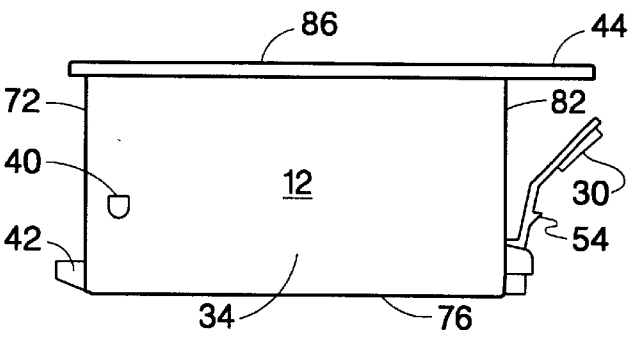
Figure 5A:
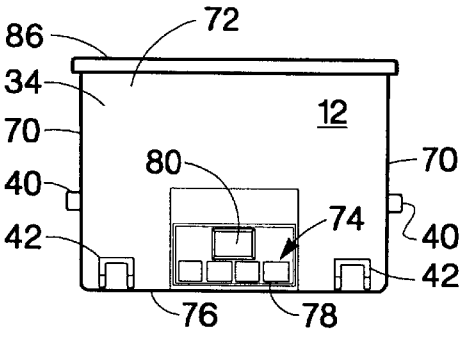
Figure 5D:
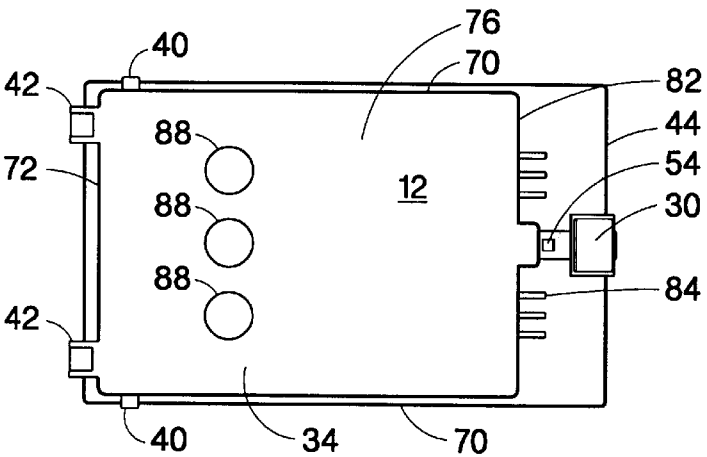

FIGS. 5*a*, 5*b*, 5*c*, and 5*d* show front plan, side plan, back plan, and bottom plan views, respectively, of the replaceable ink container 12 of the present invention. As shown in FIG. 5*a*, the replaceable ink container 12 includes a pair of outwardly projecting guide rail engagement features 40. In the preferred embodiment, each of these guide rail engagement features extend outwardly in a direction orthogonal to upright side 70 of the replaceable ink container 12. The engagement feature 42 extend outwardly from a front surface or leading edge 72 of the ink container 12. The engagement features 42 are disposed on either side of an electrical interface 74 and are disposed toward a bottom surface 76 of the replaceable ink container 12. The electrical interface 74 includes a plurality of electrical contacts 78, with each of the electrical contacts 78 electrically connected to an electrical storage device 80.

Opposite the leading end 72 is a trailing end 82 shown in FIG. 5*c*. The trailing end 82 of the replaceable ink container 12 includes the latch feature 30 having an engagement hook 54. The latch feature 30 is formed of a resilient material which allows the latch feature to extend outwardly from the trailing end thereby extending the engagement feature outwardly toward the corresponding engagement feature associated with the receiving station 14. As will be discussed, as the latch member 30 is compressed inwardly toward the trailing end 82, the latch member exerts a biasing force outwardly in order to ensure the engagement feature 54 remains in engagement with the corresponding engagement feature 50 associated with the receiving station 14 to secure the ink container 12 into the receiving station 14.

The replaceable ink container 12 also includes keying features or keys 84 disposed on the trailing end of the replaceable ink container 12. The keys are preferably disposed on either side of the latch 30 toward the bottom surface 76 of the replaceable ink container 12. The keys 84, together with keyed features 32 on the receiving station 14, interact to ensure the ink container 12 is inserted in the correct bay 56 and 58 in the receiving station 14. In addition, the keys 84 and the keyed features 32 ensure that the replaceable ink container 12 contains ink that is compatible both in color and in chemistry or compatability with the corresponding receiving bay 56 and 58 within the receiving station 14.

Also included in the ink container 12 is the handle portion 44 disposed on a top surface 86 at the trailing edge 82 of the replaceable ink container 12. The handle 44 allows the ink container 12 to be grasped at the trailing edge 82 while inserted into the appropriate bay of the receiving station 14.

Finally, the ink container 12 includes apertures 88 disposed on the bottom surface 76 of the replaceable ink container 12. The apertures 88 allow the fluid interconnect 36 to extend through the reservoir 34 to engage the capillary member disposed therein. In the case of the tri-color replaceable ink container 12, there are three fluid outlets 88, with each fluid outlet corresponding to a different ink color. In the case of the tri-color chamber, each of three fluid interconnects 36 extend into each of the fluid outlets 88 to provide fluid communication between each ink chamber and the corresponding print head for that ink color.

Figure 6:
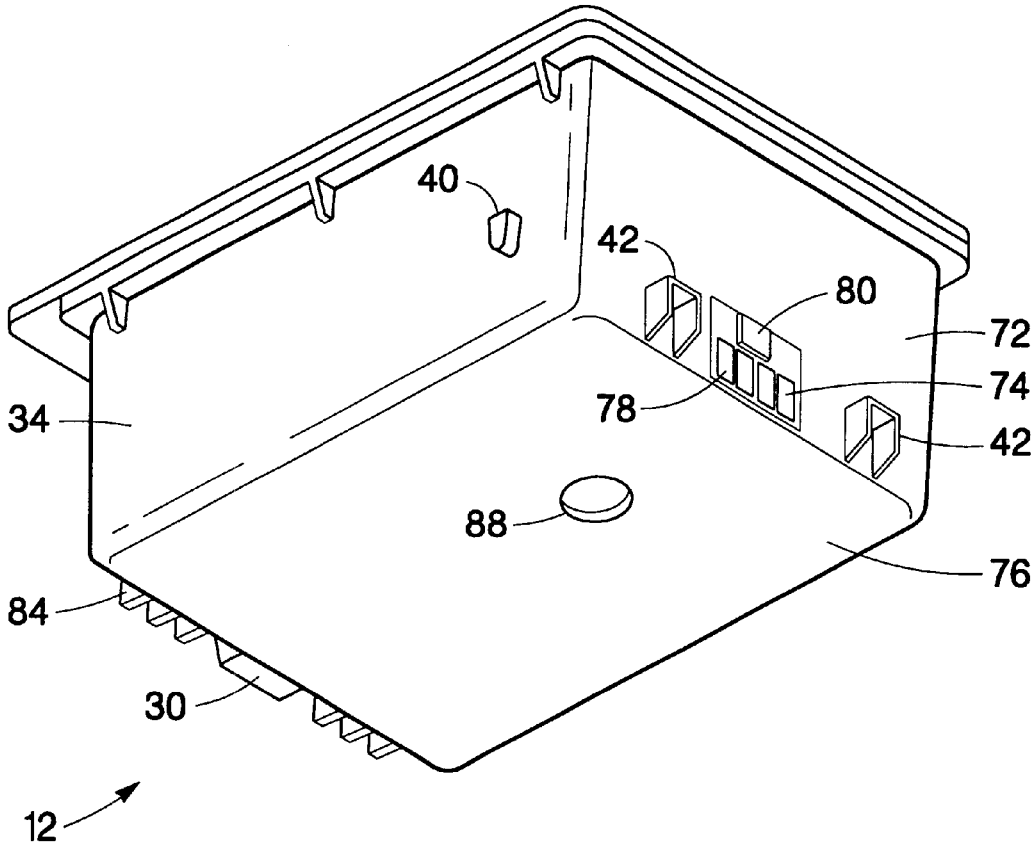
FIG. 6 is a perspective view of a single color replaceable ink container of the present invention.

FIG. 6 is a perspective view of a monochrome ink container positioned for insertion into the monochrome bay 56 in the receiving station 14 shown in FIG. 4. The monochrome ink container shown in FIG. 6 is similar to the tri-color ink container shown in FIGS. 5*a* through 5*d* except that only a single fluid outlet 88 is provided in the bottom surface 76. The monochrome replaceable ink container 12 contains a single ink color and therefore receives only a single corresponding fluid interconnect 36 for providing ink from the ink container 12 to the corresponding printhead.

Figure 7A:
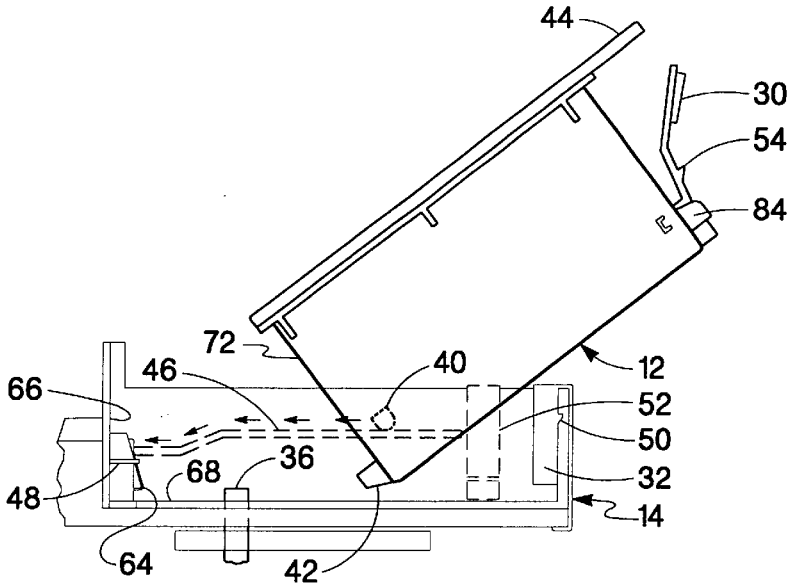
FIGS. 7*a*, 7*b*, and 7*c* depict the method for inserting the replaceable ink container into the supply station.
Figure 7B:
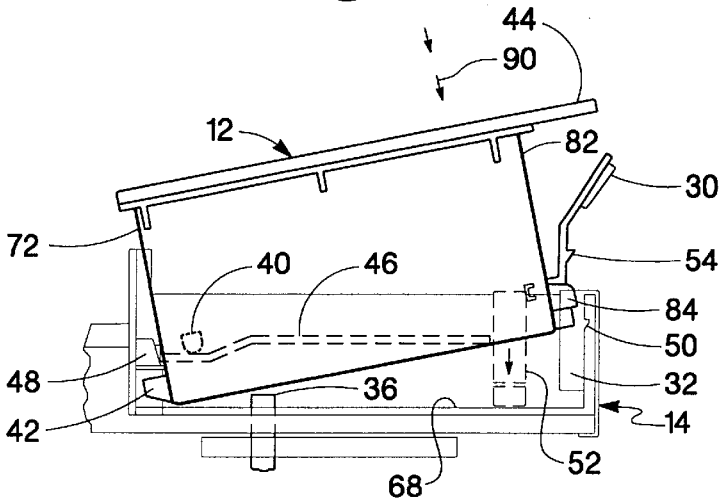
Figure 7C:
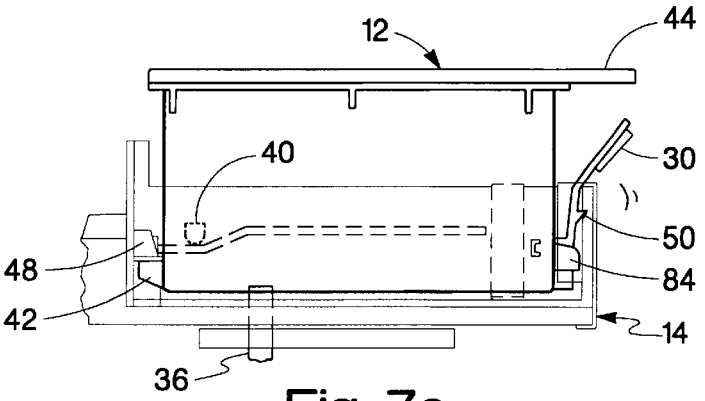

FIGS. 7*a*, 7*b*, and 7*c* are a sequence of figures to illustrate the technique of the present invention for inserting the replaceable ink container 12 into the receiving station 14 to form reliable electrical and fluidic connections with the receiving station 14.

FIG. 7*a* shows the ink container 12 partially inserted into the receiving station 14. In the preferred embodiment, the ink container 12 is inserted into the receiving station 14 by grasping the handle portion 44 and inserting the ink container into the receiving station with the leading edge or leading face 72 first. As the leading edge 72 enters the receiving station 14 the outwardly extending guide members 40 on the ink container engage each of the pair of guide rails 46. The guide rails 46 guide the ink container 12 in a horizontal or linear motion toward the back wall 66 of the receiving station 14. The guide rails 46 then guide the replaceable ink container in both a horizontal direction toward the back wall 66 and a vertical direction toward the bottom surface of the receiving station 14 such that the engagement feature 42 on the ink container 12 is received by a corresponding engagement feature 48 on the back wall 66 of the receiving station 14 as shown in FIG. 7*b*. The insertion of the ink container 12 requires only an insertion force to urge the ink container linearly along the guide rail 46. The gravitational force acting on the ink container 12 tends to cause the ink container to follow the guide rails 46 as the guide rails extend in a downward direction to allow engagement of engagement features 42 and 48. The guide rail engagement features 40 are preferably gently rounded surfaces to slide freely along the guide rails 46.

FIG. 7*b* shows the ink container 12 inserted into the receiving station 14 such that the engagement feature 42 is in engagement with the engagement feature 48 associated with the receiving station 14. A downward force is applied to the ink container 12 as represented by arrows 90 to compress the leaf spring 52 and to urge the trailing end 82 of the ink container 12 downwardly toward the bottom surface 68 of the receiving station 14. The keys 84 must properly correspond to the keyed feature 32 on the receiving station 14. If the keys 84 on the ink container 12 do not correspond to the keyed features 32, the keying system will prevent further insertion of the ink container 12 into the receiving station 14. This keying system made up of keys 84 and the keyed features 32 prevent ink containers that are not compatible with the receiving station 14 from further insertion into the receiving station 14. Further insertion of the ink container 12 into the receiving station 14 could result in contact of the fluid interconnect 36 with the capillary member within the ink container 12, thereby contaminating the fluid interconnect 36 with incompatible ink. Incompatible ink mixing in the fluid interconnect 36 can result in precipitation which can damage the printhead 16. In addition to inks of incompatible chemistries, the ink container can have an incompatible color which can result in color mixing, thereby reducing the output print quality.

The keys 84 on the ink container 12 and the keyed features 32 on the receiving station 14 allow for the complete insertion of the proper ink container 12 into the proper receiving station 14. The downward force applied to the trailing end 82 of the ink container 12 causes the ink container 12 to pivot about a pivot axis compressing the leaf spring 52, thereby moving the trailing edge 82 of the ink container 12 toward the bottom surface 68 of the receiving station 14. As the ink container 12 is urged downward into the receiving station 14, the resilient latch 30 is compressed slightly inward toward the trailing edge 82 of the ink container 12. Once the ink container 12 is urged downward sufficiently far, the engagement feature 54 on the latch 30 engages with a corresponding engagement feature 50 on the receiving station 14 to secure the ink container 12 to the receiving station 14 as shown in FIG. 7*c*.

With the ink container 12 properly secured in the receiving station 14 as shown in FIG. 7*c* the fluid interconnect 36 extends into the reservoir 34 to compress the capillary member, thereby forming a region of increased capillarity adjacent the fluid interconnect 36. This region of increased capillarity tends to draw ink toward the fluid interconnect 36, thereby allowing ink to flow through the fluid interconnect 36 to the printhead 16. In the preferred embodiment, the ink container 12 when inserted into the receiving station 14 is oriented in a gravitational frame of reference so that a gravitational force acts on ink within the ink container 12 tending to draw ink toward the bottom surface 76 of the ink container 12. Thus ink within the ink container 12 is drawn to the bottom surface 76 where this ink is drawn toward the fluid interconnect 36 by capillary attraction thereby tending to reduce or minimize stranding of ink within the ink container 12.

Figure 8B:
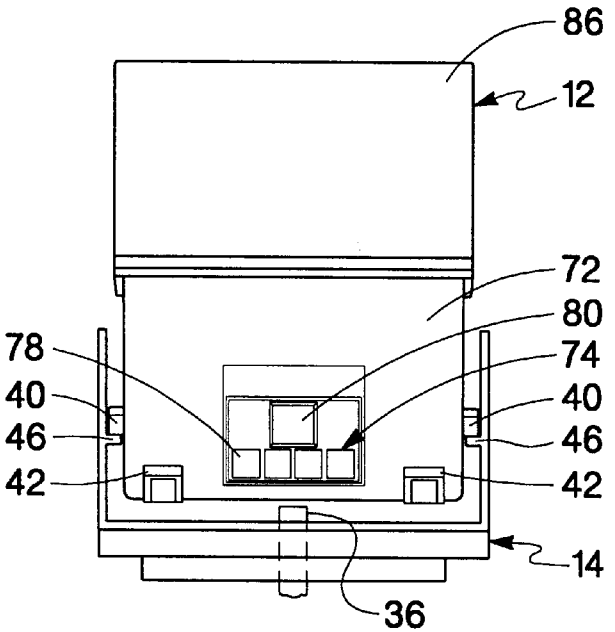
FIGS. 8*a* and 8*b* depict the passage of the replaceable ink container over an upstanding fluid inlet on the receiving station viewed from a side view and an end view, respectively.
Figure 8A:
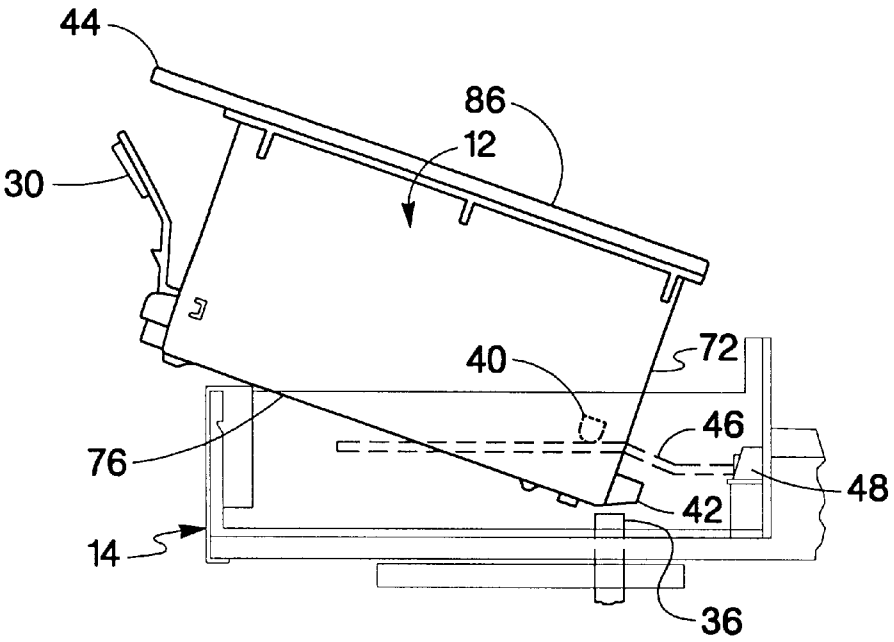

FIGS. 8*a* and 8*b* illustrate a position in the insertion process described with respect to FIGS. 7*a*, 7*b* and 7*c* wherein the leading edge 72 of the ink container 12 is positioned over the fluid interconnect 36. FIG. 8*a* depicts a side view with FIG. 8*b* showing an end view. It can be seen from FIGS. 8*a* and 8*b* that the guide feature 40 must be positioned on the ink container 12 low enough toward the bottom surface 76 of the ink container 12 such that the leading edge 72 of the ink container does not collide with the fluid interconnect 36 during insertion. Another constraint on the positioning of the guide member 40 is that the guide member 40 must be positioned sufficiently close to the top surface 86 of the ink container 12 to insure that the engagement feature 42 properly engages with the corresponding engagement feature 42 on the receiving station 14.

In addition, the outwardly extending guide members 40 on the ink container must extend outward sufficiently far to engage the guide rails 46. However, the outwardly extending guide members 40 should not extend too far outward such that the guide members 40 engage the upright sides in the receiving station 14, producing interference which produces friction and binding which resists insertion of the ink container 12 into the receiving station 14.

Figure 9A:
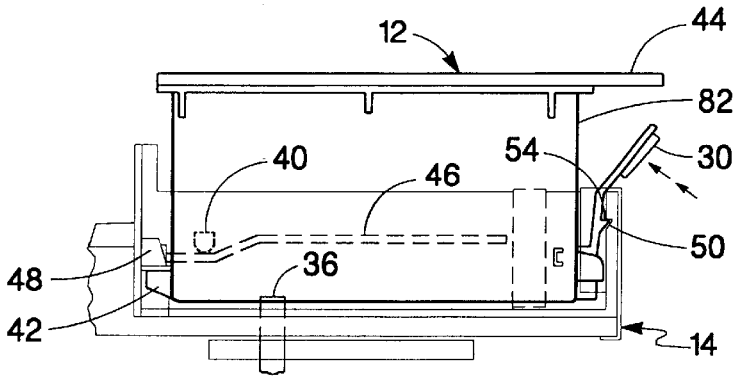
FIGS. 9*a*, 9*b*, and 9*c*, depict a method for removing the replaceable ink container from the receiving station.
Figure 9B:
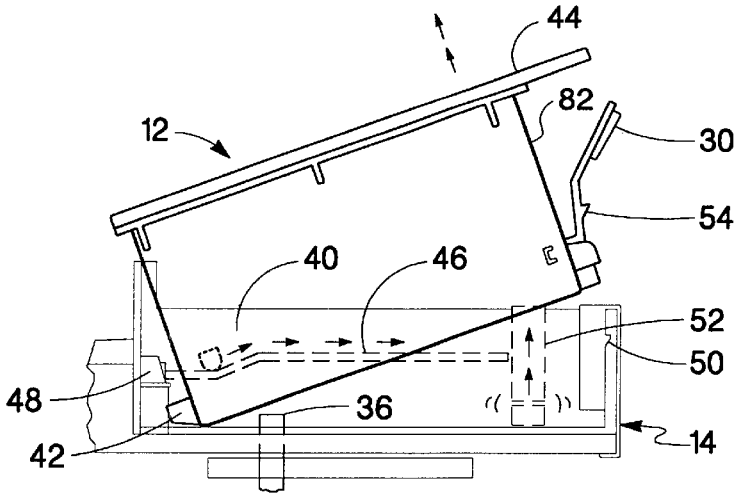
Figure 9C:
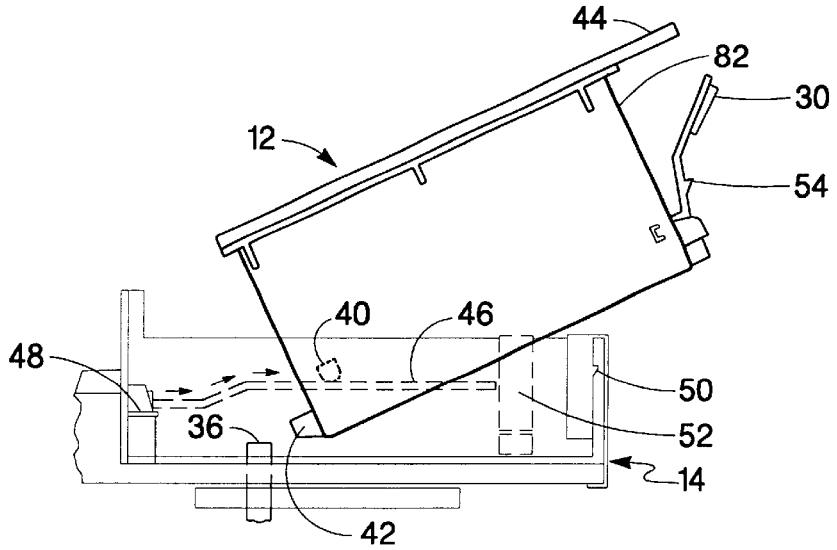

FIGS. 9*a*, 9*b*, and 9*c* illustrate the technique for removing the ink container 12 from the receiving station 14. The technique for removing the ink container 12 of the present invention begins with the release of the engagement feature from the corresponding engagement feature 50 on the receiving station 14 by urging the latch 30 toward the trailing surface 82. Once the trailing edge of the ink container 12 is released, the spring 52 urges the trailing edge of the ink container upward as shown in FIG. 9*b*. The ink container 12 can be grasped by handle 44 to retrieve the ink container 12 in a direction opposite the insertion direction. As the ink container 12 is withdrawn from the receiving station 14, the guide member 40 follows the guide rails 46 to lift the ink container, thereby preventing interference between the fluid interconnect 36 and the fluid outlet on the bottom surface of the ink container 12.

The ink container 12 of the present invention is configured to engage and interact with the receiving station 14 to guide the ink container 12 into the receiving station and for a reliable fluid and electrical connection with the receiving station 14. The technique of the present invention allows this insertion process to be relatively simple and easy to prevent improper insertion of the ink container 12. The customer grasps the ink container 12 by the handle portion 44 and slides the ink container 12 horizontally into the receiving station 14. The guide rails 46 and guide features 40 cooperate to properly guide the ink container 12 into the receiving station 14. The ink container 12 is pressed downwardly to latch the ink container 12 and achieve operational interconnection both electrically and fluidically between the ink container 12 and the receiving station 14.

FIGS. 10*a* through 10*j* are top plan representations showing the trailing edge 82 of the ink container 12 positioned proximate a corresponding receiving station 14. The ink container 12 is positioned in a spaced relationship from the receiving station 14 in order to better illustrate the complementary relationship between the keys 84 on the ink container 12 and the keyed features 32 on the receiving station 14. With the ink container 12 properly inserted into the receiving station 14, the keys 84 are inserted into the keyed portion 32 as will be discussed with respect to FIG. 11.

Figure 10A:
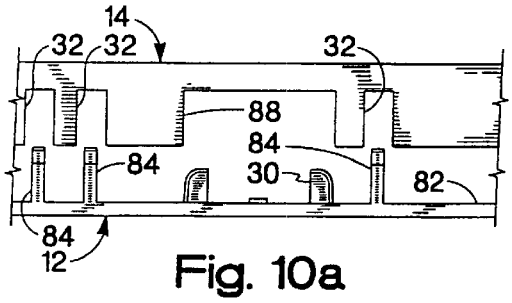
FIGS. 10*a* through 10*j* depict top plan views, in breakaway, of various arrangements of keying portions for the ink container shown spaced from the corresponding keyed portions associated with the receiving station.
Figure 10B:
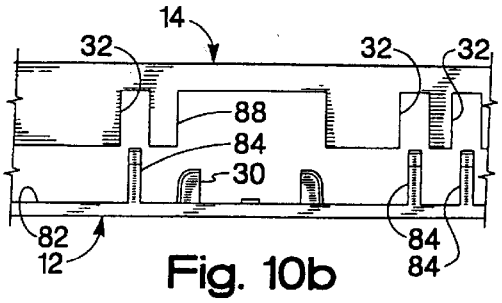
Figure 10C:
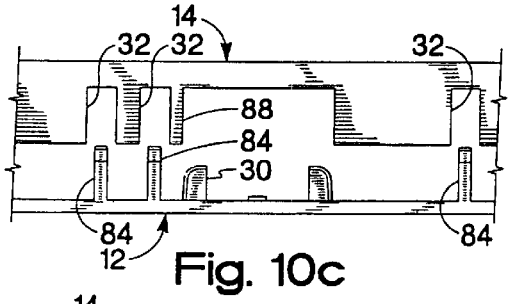
Figure 10D:
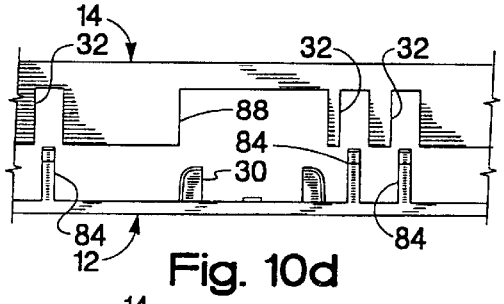
Figure 10E:
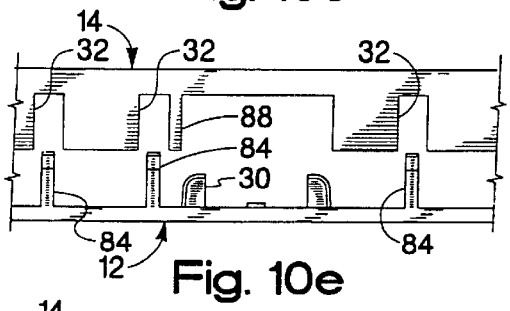
Figure 10F:
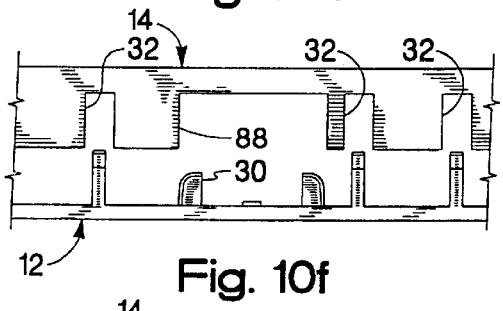
Figure 10G:
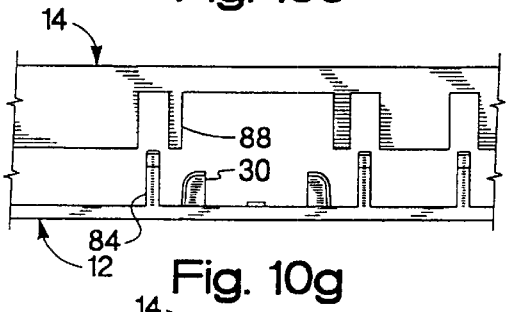
Figure 10H:
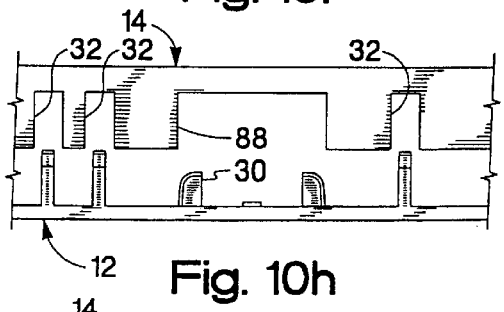
Figure 10I:
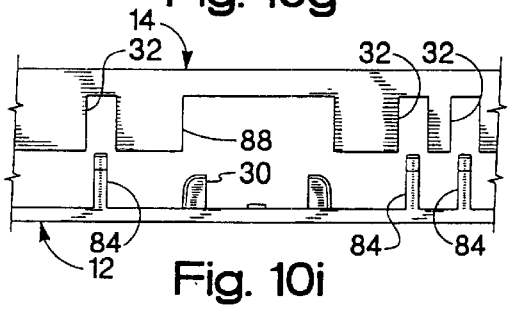
Figure 10J:
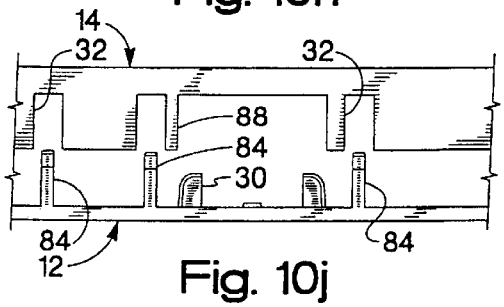

In a preferred embodiment, the keys 84 and the keyed features 32 for the tri-color bay 58 shown in FIG. 4 as represented by FIG. 10*a*, are opposite arrangements or mirror images of the arrangement of the keys 84 and keyed features 32 on the monochrome bay 56 as represented by FIG. 10*b*. The arrangement of keys 84 and keying features 32 in mirror images or opposite pairs provides a benefit to the customer by providing a visual clue to aid the customer in positioning the ink container 12 in the proper bay within the receiving station 14. By arranging the keys 84 and keying features 32 as opposite pairs, it is more clear to the customer which by 56, 58 in which to install the ink container 12. The arrangement of opposite pairs does not require the customer to carefully review individual key spacings, but instead the customer merely has to recognize the overall appearance of the keying arrangement to decide which bay is appropriate.

In addition, placement of the keys 84 on the trailing edge 82 of the ink container 12 allows the customer to view the arrangement of keys 84 as the ink container 12 is inserted into the receiving station 14. By positioning the keys 84 on the trailing edge 82, the customer can view both the keys 84 and the keyed portions 32 of the receiving station 14 to rapidly determine whether the ink container 12 is inserted into the proper bay 56, 58 of the receiving station 14. Finally, by positioning the keys 84 adjacent the bottom surface 76 of the ink container 12, the keys 84 and the keyed portions 32 cooperate to prevent insertion of non-compatible ink containers 12 into the receiving station 14 sufficiently to prevent fluid communication between the ink container 12 and the receiving station 14. Thus, the positioning of the keys 84 ensures that ink of a different color or of a different ink type will not contaminate the fluidic path between the receiving station 14 and the printhead 16.

Additional opposite pairs of keying arrangements are shown in FIGS. 10*c* and 10*d*, 10*e* and 10*f*, 10*g* and 10*j*, 10*i* and 10*h*. Each of these arrangements of keys and keyed portions 32 make use of an arrangement whereby six evenly spaced keys are formed on the ink container 12, and three are removed to identify the ink type and ink color within the ink container 12. By molding six keys 84 and removing three of them, the greatest number of unique keyed permutations can be created. In addition, by using three keys 84, if any key is broken or is damaged, there are two other keys that are available to provide keying functions, thereby insuring that even a damaged in ink container 12 will not be inserted into the wrong receiving station 14.

The opposite pairs of keying arrangements shown in FIGS. 10*a* through 10*j* are discussed with respect for use with black and tri-color ink containers 12 that are inserted into corresponding black and tri-color bays 56 and 58, respectively, on the receiving station 14. This opposite pair arrangement of keying features 84 can be used in other arrangements of ink containers 12 as well. For example, in the case of a seven-color printer, six different color inks and black ink is used to form images. For this type of printer the ink containers 12 can be arranged in two tri-color ink containers 12, and a black ink container 12. Each of the tri-color ink containers 12 can make use of opposite pairs of keying features 84 to prevent insertion of each of the tri-color ink containers 12 into the wrong bay of the receiving station 14.

A cut-out 88 is formed in the receiving station 14 to accommodate the latch feature 30 on the ink container 12. The latch feature 30 is shown in figs. 10*a* through 10*j* as partially removed for simplicity.

Figure 11:
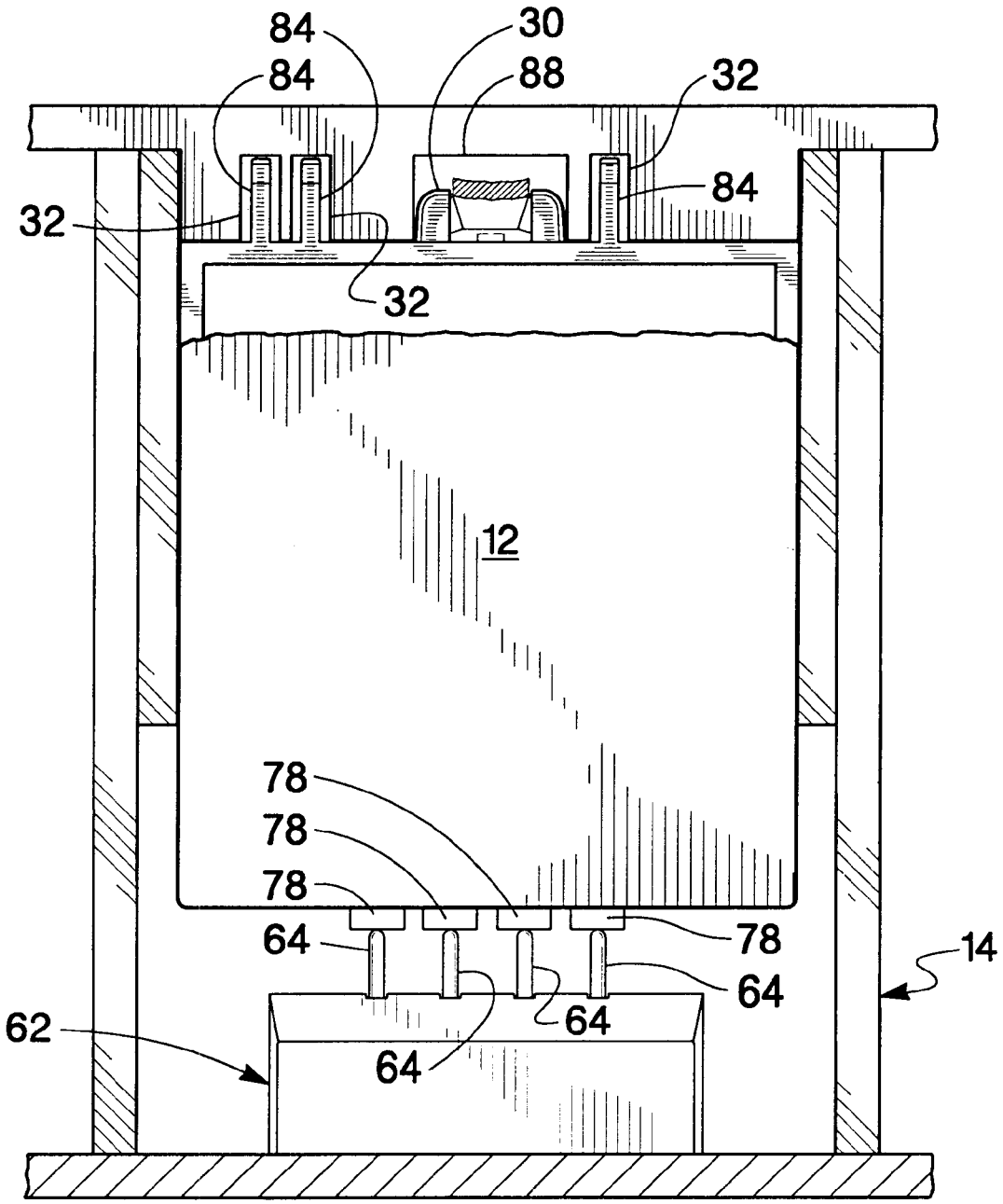
FIG. 11 is a representation of the ink container of FIG. 10*a* shown fully inserted into a corresponding receiving station shown from a top plan view.

FIG. 11 is a top plan view of the ink container 12 installed into the receiving station 14. The ink container 12 is shown with the keying arrangement 84 and corresponding keyed features 32 as shown in FIG. 10*a*. The keys 84 and the keyed features 32 cooperate to ensure that the proper ink container 12 and corresponding proper ink type and color are inserted into the corresponding receiving station 14.

What is claimed is:

1. A replaceable ink container for providing ink to an inkjet printing system, the inkjet printing system having a scanning carriage having a receiving station mounted thereon for receiving the replaceable ink container, the receiving station having a fluid inlet fluidically coupled to an inkjet printhead, and a keyed portion indicative of a replaceable ink container parameter of a plurality of replaceable ink container parameters, the replaceable ink container comprising:

a reservoir portion having a leading end and an opposite trailing end, the leading end being defined as that end of the reservoir portion first received by the receiving station upon insertion of the replaceable ink container into the receiving station;

a fluid outlet associated with the reservoir portion and connectable to the fluid inlet associated with the receiving station; and a keying portion disposed on the trailing end, wherein the keying portion is indicative of an ink parameter of ink contained within the reservoir portion of the replaceable ink container, wherein the keying portion is disposed on the reservoir portion of the replaceable ink container to engage the keyed portion on the receiving station before fluid communication is established between the fluid outlet of the replaceable ink container and the fluid inlet of the receiving station, and wherein the keying portion is complementary to the keyed portion of the receiving station thereby allowing the replaceable ink container to be fully inserted into the receiving station.

2. The replaceable ink container of claim 1 wherein the keying portion is a plurality of tabs that extend outwardly from the trailing end of the reservoir portion.

3. The replaceable ink container of claim 2 wherein the reservoir portion of the replaceable ink container has a top surface and a bottom surface extending between the leading and trailing ends, and wherein the tabs are disposed in a side by side relationship on the trailing end of the reservoir portion toward the bottom surface of the reservoir portion.

4. The replaceable ink container of claim 1 wherein the keying portion is indicative of one of ink color and ink compatibility.

5. The replaceable ink container of claim 1 wherein when the replaceable ink container is compatible with the receiving station, the keying portion is aligned with and can engage the keyed portion thereby allowing the replaceable ink container to be fully inserted into the receiving station.

6. The replaceable ink container of claim 1 wherein the keying portion is a plurality of tabs that extend outwardly from the reservoir portion and wherein the keying portion is made complementary to the keyed portion by selective removal of at least one of the plurality of tabs.

7. The replaceable ink container of claim 1 wherein insertion of replaceable ink containers that are not compatible with the receiving station is prevented by keying portions that cannot be aligned with and therefore cannot engage the keyed portion of the receiving station.

8. The replaceable ink container of claim 1 wherein the replaceable ink container is initially inserted into the receiving station in a horizontal direction where the keying portion is positioned proximate the keyed portion, and wherein the replaceable ink container is then pivoted about a pivot axis and fully inserted into the receiving station such that the fluid outlet disposed on the reservoir portion is engaged with the fluid inlet disposed on the receiving station only when the keying portion is compatible with the keyed portion.

9. A replaceable ink container for providing ink to an inkjet printing system, the inkjet printing system having a scanning carriage having a receiving station therein for receiving the replaceable ink container, the receiving station having a back wall, a bottom surface having a fluid inlet disposed thereon that is fluidically coupled to an ink ejection device, and a front wall having a keyed feature disposed thereon, the replaceable ink container comprising:

an ink container housing having a leading end and an opposite trailing end, the leading end being defined as that end of the ink container housing first received by the receiving station upon insertion of the replaceable ink container into the receiving station;

a fluid outlet associated with the ink container housing and connectable to the fluid inlet associated with the receiving station; and a keying feature is indicative of an ink parameter of ink contained within the ink container housing, wherein the keying feature is disposed on the trailing end of the ink container housing to engage the keyed feature on the receiving station before fluid communication is established between the fluid outlet of the ink container housing and the fluid inlet of the receiving station so that with the insertion of the replaceable ink container into the receiving station in first a linear direction toward the back wall of the receiving station to align the fluid outlet with the fluid inlet, the keying feature engages the keyed feature allowing further insertion of the replaceable ink container into the receiving station in a second direction toward the bottom surface of the receiving station, only when the keying feature is complementary with the keyed feature, thereby allowing fluid communication between the replaceable ink container and the receiving station.

10. The replaceable ink container of claim 9 wherein the keying feature is a plurality of tabs that extend outwardly from the ink container housing.

11. The replaceable ink container of claim 10 wherein the ink container housing has a top surface and a bottom surface extending between the leading and trailing ends, and wherein the plurality of tabs are disposed in a side by side relationship toward the bottom surface of the trailing end.

12. The replaceable ink container of claim 9 wherein the keying feature is indicative of one of ink color and ink compatibility.

13. The replaceable ink container of claim 9 wherein when the replaceable ink container is compatible with the receiving station, the keying feature is aligned with and can engage the keyed feature thereby allowing the replaceable ink container to be fully inserted into the receiving station.

14. The replaceable ink container of claim 9 wherein the keying feature is a plurality of tabs that extend outwardly from the ink container housing and wherein the keying feature is made complementary to the keyed feature by selective removal of at least one of the plurality of tabs.

15. The replaceable ink container of claim 9 wherein insertion of replaceable ink containers that are not compatible with the receiving station is prevented by keying features that cannot be aligned with and therefore cannot engage the keyed feature of the receiving station.

16. The replaceable ink container of claim 9 wherein further insertion in the second direction toward the bottom surface of the receiving station by pivoting the replaceable ink container about a pivot axis to engage the a fluid outlet disposed on the ink container housing with the fluid inlet disposed on the receiving station is accomplished only when the keying feature is compatible with the keyed feature.

17. A method for inserting a replaceable ink container into a receiving station of an inkjet printing system, the receiving station disposed on a scanning carriage and having a fluid inlet fluidically coupled to an ink ejection portion mounted thereon, the method for inserting the replaceable ink container comprising:

inserting the replaceable ink container linearly toward a back wall of the receiving station such that a leading end of the replaceable ink container is first received by the receiving station and a keying feature, on a trailing end of the replaceable ink container opposite the leading end and indicative of an ink parameter of ink contained within the replaceable ink container, is in alignment with a keyed feature on the receiving station, and the keying feature disposed on the replaceable ink container engages the keyed feature on the receiving station before fluid communication is established between a fluid outlet of the replaceable ink container and the fluid inlet of the receiving station,; and further inserting the replaceable ink container downward toward a bottom surface of the receiving station so that the keying feature and keyed feature cooperate to allow further insertion of the replaceable ink container to operably couple a the fluid outlet on the replaceable ink container with the fluid inlet disposed proximate the bottom surface of the receiving station.

18. The method of claim 17 wherein insertion of non-compatible replaceable ink containers and thereby coupling between fluid outlets on the non-compatible replaceable ink containers and the fluid inlet is prevented by keying features that cannot be aligned with and therefore can not engage the keyed feature of the receiving station.

19. A method of manufacturing a replaceable ink container for insertion into a receiving station of an inkjet printing system, the receiving station having a keyed portion corresponding to a compatible replaceable ink container of a plurality of replaceable ink containers, the method of manufacturing comprising:

forming a reservoir having a bottom surface having a fluid outlet therein and an opposite top surface, the reservoir further including a leading end and an opposite trailing end, the leading end being defined as that end of the reservoir first received by the receiving station upon insertion of the reservoir into the receiving station, the trailing end having a plurality of keying features disposed toward the bottom surface, wherein the plurality of keying features are indicative of an ink parameter of ink contained within the reservoir; and removing at least one keying feature of the plurality of keying features from the trailing end of the reservoir to correspond with the compatible replaceable ink container.

20. The method of manufacturing the replaceable ink container of claim 19 further including filling the reservoir with ink, wherein the ink corresponds to the compatible replaceable ink container.

21. The method of manufacturing the replaceable ink container of claim 19 wherein the plurality of keying features are a plurality of tabs extending outwardly from the reservoir.

22. A replaceable ink container of a pair of replaceable ink containers for insertion into a receiving station of an inkjet printing system, the receiving station having a pair of bays with each bay, of the pair of bays, for receiving a selected replaceable ink container of the pair of replaceable ink containers, the replaceable ink container comprising:

a reservoir for containing a quantity of ink, the reservoir having a leading end and an opposite trailing end, the leading end being defined as that end of the reservoir first received by the receiving station upon insertion of the replaceable ink container into the receiving station; and a plurality of keying features disposed on the trailing end of the reservoir and being indicative of an ink parameter of the quantity of ink contained within the reservoir, the plurality of keying features corresponding to a first bay of the pair of bays, the plurality of keying features arranged in a mirror image arrangement from corresponding keying features associated with replaceable ink containers receivable by a second bay of the pair of bays so as to prevent insertion of the reservoir of the replaceable ink container corresponding to the first bay of the pair of bays in the second bay of the pair of bays.

23. The replaceable ink container of claim 22 wherein the plurality of keying features are three extending tabs that are selectively disposed on the reservoir in a spaced relationship relative to one another.

24. The replaceable ink container of claim 22 wherein the pair of replaceable ink containers includes a monochrome replaceable ink container for containing black ink and a tri-color replaceable ink container for containing three separate ink colors and wherein the pair of bays includes a monochrome bay configured for receiving the monochrome replaceable ink container and a tri-color bay configured to receive the tri-color replaceable ink container.

25. The replaceable ink container of claim 24 wherein the first bay is a monochrome bay and the second bay is a tri-color bay and the plurality of keying features for the monochrome bay are mirror images of corresponding plurality of keying features associated with the tri-color bay.

26. The replaceable ink container of claim 24 wherein the first bay is a tri-color bay and the second bay is a monochrome bay and the plurality of keying features for the tri-color bay are mirror images of corresponding plurality of keying features associated with the monochrome bay.

* * * * *

UNITED STATES PATENT AND TRADEMARK OFFICE

CERTIFICATE OF CORRECTION

PATENT NO. : 6,375,315 B1 
DATED : April 23, 2002
INVENTOR(S) : Charles R. Steinmetz et al.

It is certified that error appears in the above-identified patent and that said Letters Patent is hereby corrected as shown below:

Title page,
After *Primary Examiner*, it should read -- *Attorney, Agent or Firm*--Kevin B. Sullivan --.

Signed and Sealed this

Twenty-first Day of January, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,375,315 B1
DATED : April 23, 2002
INVENTOR(S) : Charles R. Steinmetz et al.

It is certified that error appears in the above-identified patent and that said Letters Patent is hereby corrected as shown below:

Column 13,
Line 38, “couple a” should read -- couple --.

Signed and Sealed this

Fifth Day of August, 2003

JAMES E. ROGAN
*Director of the United States Patent and Trademark Office*